US008397607B2

(12) United States Patent
Huang

(10) Patent No.: US 8,397,607 B2
(45) Date of Patent: Mar. 19, 2013

(54) ANGLE ADJUSTABLE HANDLE FOR A HAND TOOL

(76) Inventor: Chin-Tan Huang, Dali (TW)

( * ) Notice: Subject to any disclaimer, the term of this patent is extended or adjusted under 35 U.S.C. 154(b) by 277 days.

(21) Appl. No.: 12/973,330

(22) Filed: Dec. 20, 2010

(65) Prior Publication Data

US 2012/0048071 A1 Mar. 1, 2012

(30) Foreign Application Priority Data

Sep. 1, 2010 (TW) ..... 99129477 A

(51) Int. Cl.
*B25B 23/16* (2006.01)

(52) U.S. Cl. ..... 81/177.8; 81/177.9

(58) Field of Classification Search ..... 81/177.7, 81/177.8, 177.9; 403/68, 71, 78, 91, 98, 403/160, 204; 16/110.1, 900
See application file for complete search history.

(56) References Cited

U.S. PATENT DOCUMENTS 2,542,038 A * 2/1951 Lewis ..... 173/206
4,759,240 A * 7/1988 Lin ..... 81/177.8
5,372,420 A * 12/1994 Van Deursen et al. ..... 366/129
6,039,126 A * 3/2000 Hsieh ..... 173/216
6,401,301 B1 * 6/2002 Hung ..... 16/430
6,405,620 B2 * 6/2002 Liao ..... 81/177.7
7,328,635 B2 * 2/2008 Hu ..... 81/177.9
7,347,127 B2 * 3/2008 Hu ..... 81/177.9
7,434,496 B2 * 10/2008 Hu ..... 81/177.7
7,481,135 B2 * 1/2009 Schoenbeck et al. ..... 81/177.7
7,571,517 B2 * 8/2009 Smith et al. ..... 16/436

* cited by examiner

*Primary Examiner* — David B Thomas

(74) *Attorney, Agent, or Firm* — Novak Druce Connolly Bove + Quigg LLP

(57) ABSTRACT

An angle adjustable handle includes a first shank and a second shank coupled with each other by means of a plug extending in a swivel axis from the first shank and a socket fastened to the second shank. The socket has two body halves tightened to each other and having two socket ends that cooperatively define a socket cavity for accommodating the plug so as to permit the socket to be swivelable about the swivel axis between normal and angle-adjusted positions. A spring-loaded latch is disposed in the first shank and movable to engage or disengage from the socket to permit or prevent movement of the socket.

12 Claims, 10 Drawing Sheets

ANGLE ADJUSTABLE HANDLE FOR A HAND TOOL

CROSS-REFERENCE TO RELATED APPLICATION

This application claims priority of Taiwanese Patent Application. No. 099129477, filed on Sep. 1, 2010, the disclosure of which is herein incorporated by reference.

BACKGROUND OF THE INVENTION

1. Field of the Invention

This invention relates to an angle adjustable handle for a hand tool, more particularly to an angle adjustable handle having first and second shanks swivelable to each other between normal and angle-adjusted positions.

2. Description of the Related Art

U.S. Pat. No. 7,347,127 B2 discloses a screwdriver handle that includes a first shank and a second shank. An axial plug is formed on an end face of the first shank for pivotally engaging a groove in an end face of the second shank. A C-shaped snap fastener is disposed to retain the axial plug in the groove. Two positioning members are disposed in the first shank and are biased to engage the second shank. A control member is mounted in the second shank and is movable to urge the positioning member so as to permit the first shank to be rotatable relative to the second shank between an in-line state and an angle-adjusted state.

Another screwdriver handle, such as those disclosed in U.S. Pat. Nos. 7,434,496 B2 and 6,405,620 B2, has a similar construction except for structure and operation of the positioning member and the control member.

However, the axial plug and the snap fastener are liable to wear and break after long-time twisting operation between the first and second shanks, which renders the whole second shank unfit for long-life serviceable and usable.

SUMMARY OF THE INVENTION

An object of the present invention is to provide an angle adjustable handle for a hand tool which has a simple construction having component parts that are convenient to be replaced when they are worn out.

According to this invention, the angle adjustable handle includes a first shank extending along a first lengthwise axis to terminate at a first major surface, a plug extending from the first major surface a long a swivel axis that is normal to the first major surface, and that is at an angle with the first lengthwise axis, a second shank extending along a second lengthwise axis to terminate at a second major surface that has an insertion opening extending along the second lengthwise axis, and a socket configured to be insertable into the insertion opening. The socket has left and right body halves which are opposite to each other radially to the second lengthwise axis and which are brought toward the second lengthwise axis to be tightened to each other. The left and right body halves respectively have left and right rear socket ends which extend in a circumferential direction about the swivel axis to define a socket cavity for accommodating the plug, and which cooperatively define an abutment surface configured to abut against the first major surface. Hence, the socket is swivelable about the swivel axis between a normal position, where the first and second lengthwise axes are aligned with each other, and an angle-adjusted position, where the first and second lengthwise axes are at an angle with each other. A spring-loaded latch is disposed in the first shank and is movable between a retracted position, where the latch is disposed inwardly of the first major surface, and an extended position, where the latch extends into the abutment surface to thereby prevent the socket from moving away from a selected one of the normal and angle-adjusted positions.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
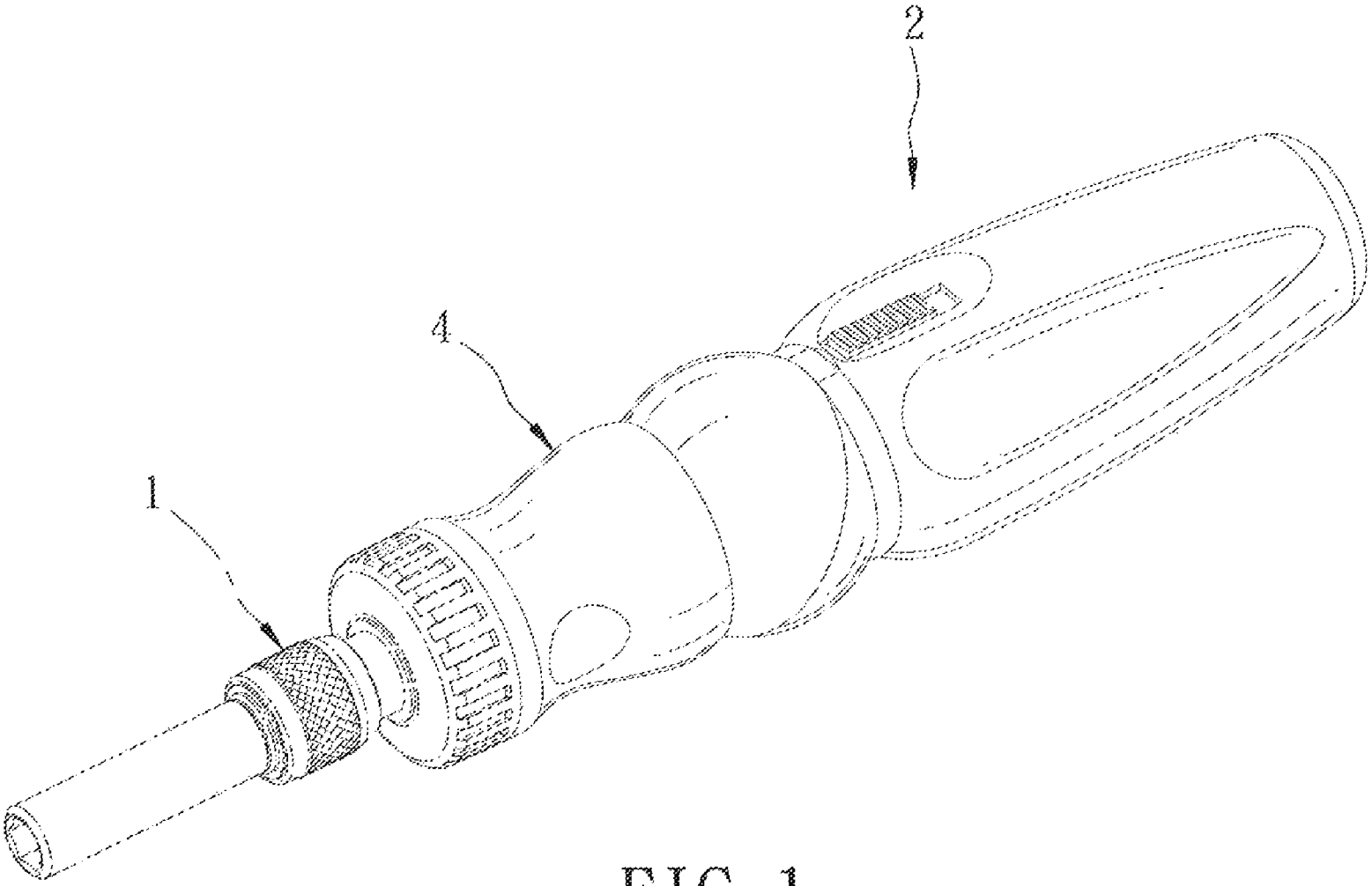
FIG. 1 is a perspective view of the first preferred embodiment of an angle adjustable handle for a hand tool according to this invention.
Figure 2:
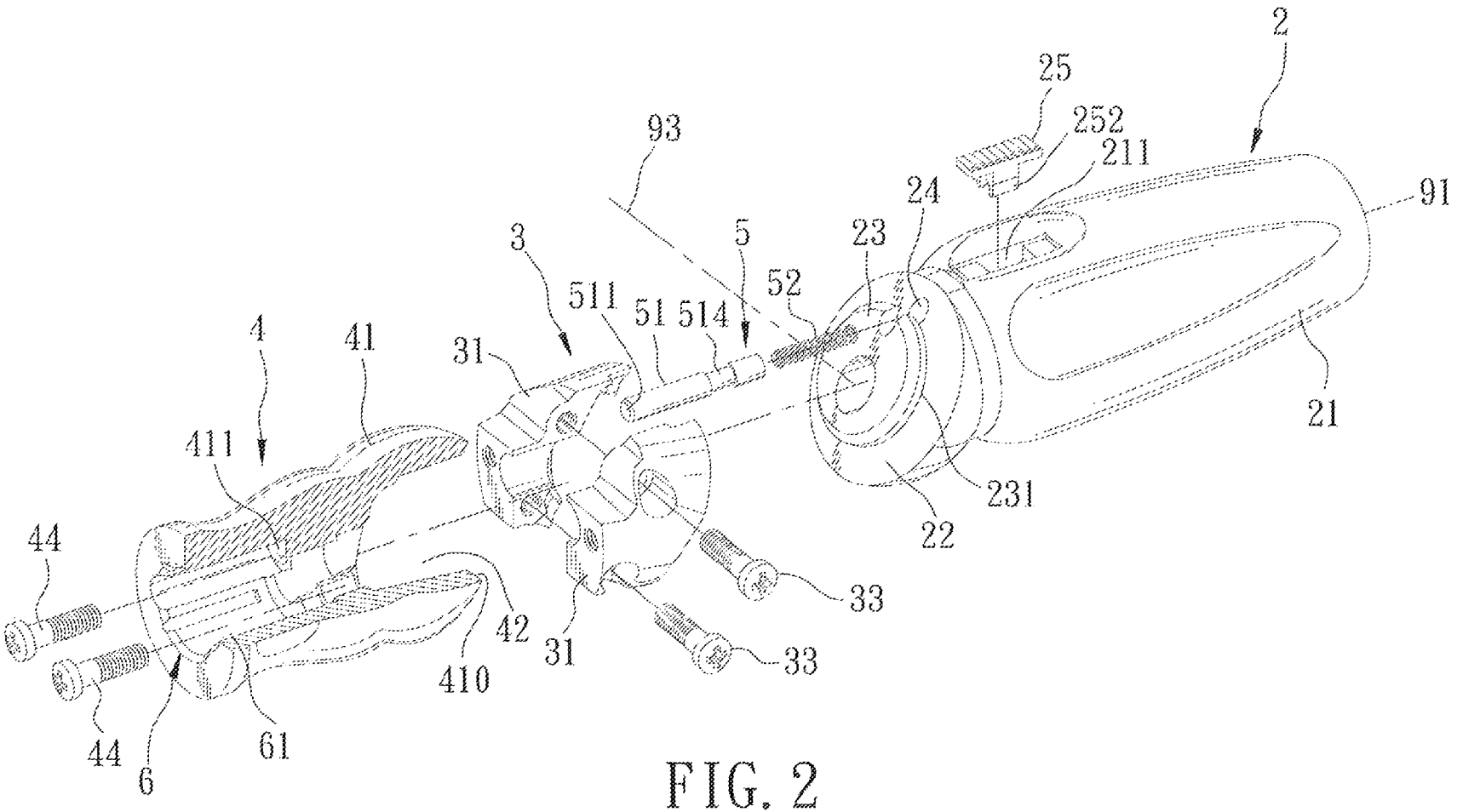
FIG. 2 is a partly fragmentary, exploded perspective view of the first preferred embodiment.
Figure 3:
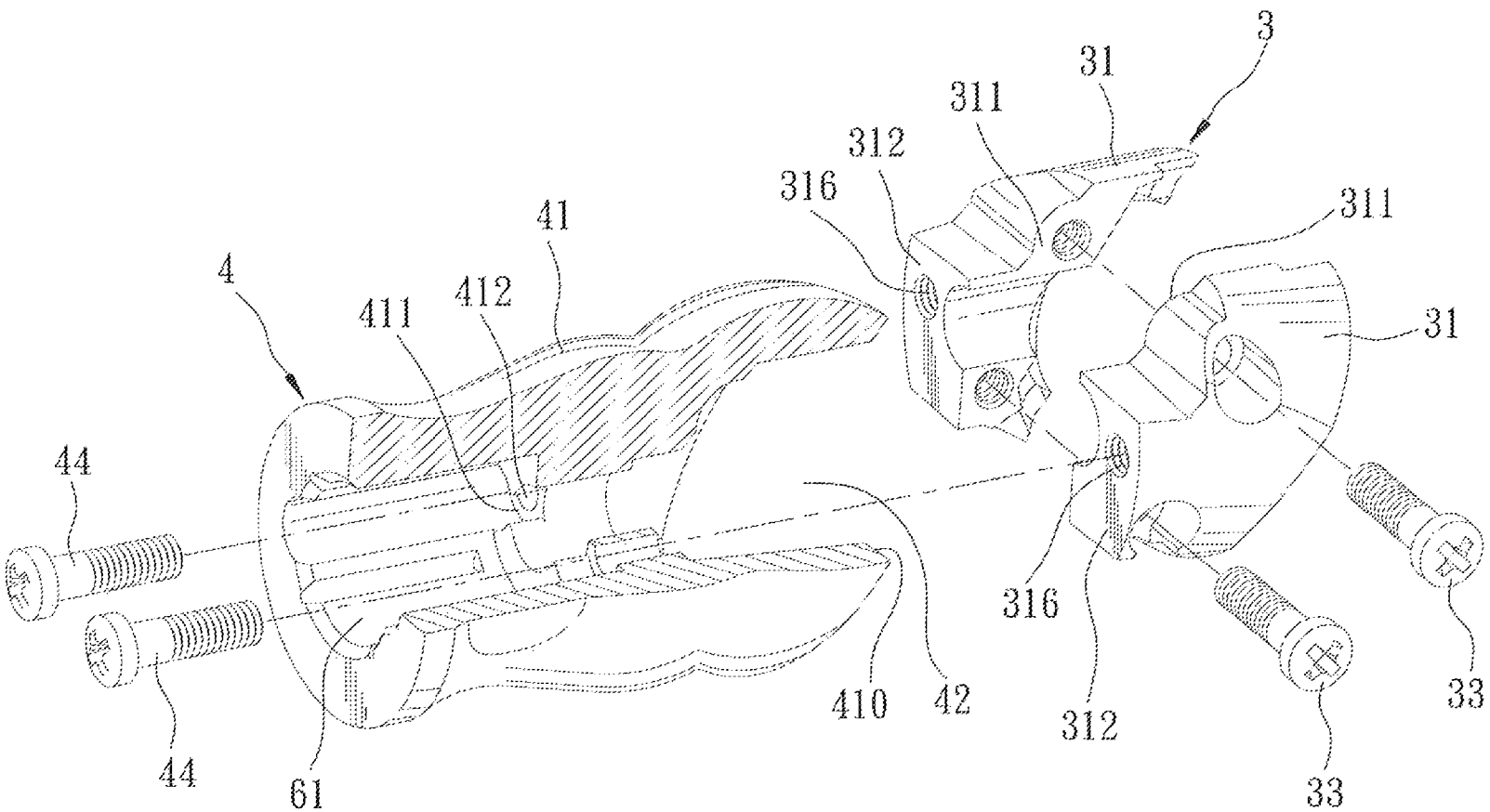
FIG. 3 is a partly fragmentary, exploded perspective view of a portion of the first preferred embodiment.
Figure 4:
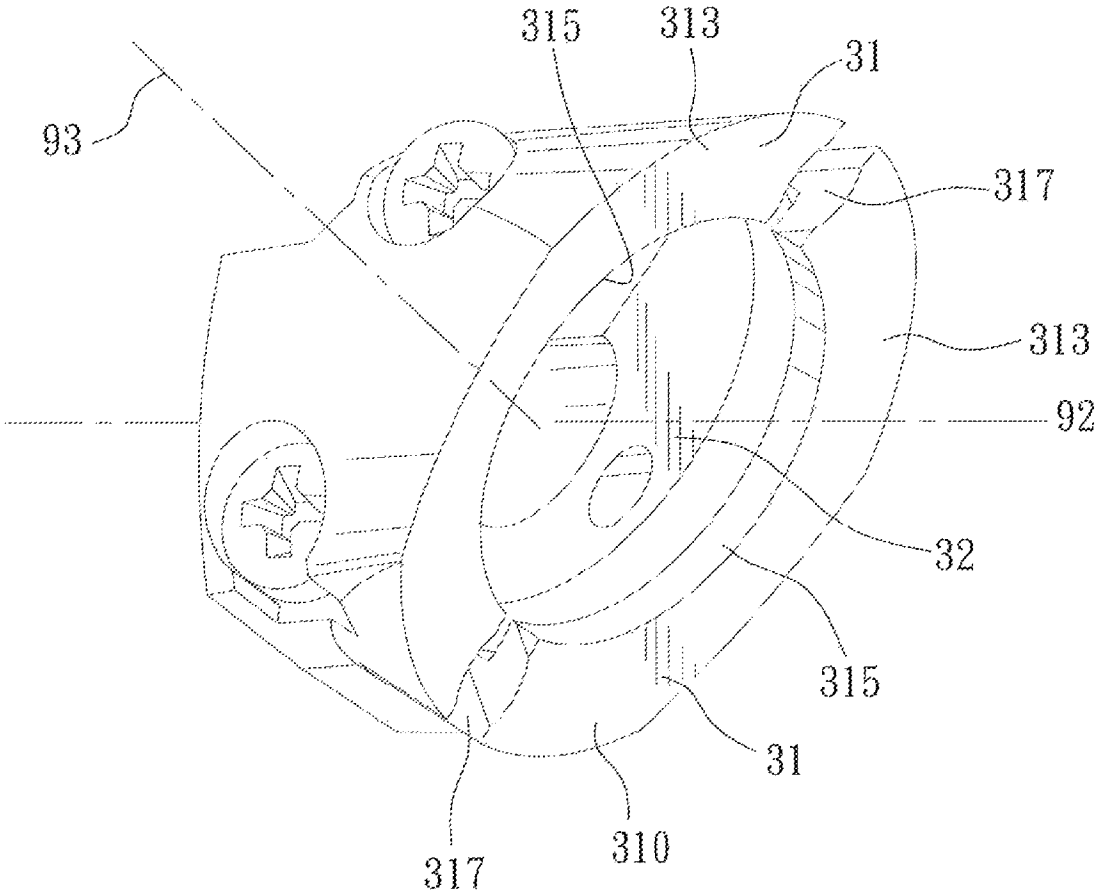
FIG. 4 is a perspective view of a socket of the first preferred embodiment.

Before the present invention is described in greater detail, it should be noted that same reference numerals have been used to denote like elements throughout the specification.

Referring to FIGS. 1 to 4, the first preferred embodiment of an angle adjustable handle according to the present invention is adapted for mounting a tool bit 1 of a hand tool, such as a screwdriver, and is shown to comprise a first shank unit 2, a second shank unit 4, a socket 3, and a latch unit 5.

The first shank unit 2 includes a first shank 21 and a plug 23. The first shank 21 extends along a first lengthwise axis 91 to terminate at a first major surface 22. The plug 23 extends from the first major surface 22 along a swivel axis 93 that is normal to the first major surface 22, and that is at an angle with the first lengthwise axis 91. The first shank 21 has a tubular hole 24 extending along a direction of the first lengthwise axis 91 through the first major surface 22 and the plug 23, and a radial opening 211 extending radially and communicated with the tubular hole 24. The plug 23 has a guiding groove 231 extending in a circumferential direction about the swivel axis 93. An operating member 25 is operably disposed in the radial opening 211.

The second shank unit 4 includes a second shank 41 extending along a second lengthwise axis 92 to terminate at a second major surface 410 that is configured to abut against the first major surface 22 and that has an insertion opening 42 extending along the second lengthwise axis 92. A spline hole 61 is formed in the second shank 41 and extends along the second lengthwise axis 92 to serve as a bit mounting portion 6 for receiving and gripping a tool bit 1. Note that the bit mounting portion 6 may be formed in the first shank 21 and extends in the first lengthwise axis 91. The second shank 41 further has a partition seat 411 which is interposed between the spline hole 61 and the insertion opening 42 and which has two through holes 412.

The socket 3 is configured to be insertable into the insertion opening 42, and has left and right body halves 31 which are made from metal material and which are opposite to each other radial to the second lengthwise axis 92. The left and right body halves 31 are brought toward the second lengthwise axis 92 to be tightened to each other. In this embodiment, a fastening unit includes two screw fasteners 33 disposed to extend transversely relative to the second lengthwise axis 92 through one of the body halves 31 and threadedly engaged in the other one of the body halves 31 to permit abutment of inner abutment surfaces 311 of the body halves 31 against each other. The left and right body halves 31 respectively have left and right rear socket ends 313 which extend in the circumferential direction to define a socket cavity 32 for accommodating the plug 23, and which cooperatively define an abutment surface 310 configured to be coplanar with the second major surface 410 to abut against the first major surface 22. The left and right body halves 31 respectively have left and right inner flanges 315 which respectively extend from the left and right rear socket ends 313 and towards the swivel axis 93, and which are brought to be fitted in and swivelable relative to the guiding groove 231 about the swivel axis 93. The left and right rear socket ends 313 are spaced apart from each other in the circumferential direction by two locking gaps 317 which are diametrically opposite to each other relative to the second lengthwise axis 92. Moreover, the left and right body halves 31 respectively have left and right front ends 312 which abut against and are fastened to the partition seat 411 by means of two screw fasteners 44 that extend through the through holes 412 and that are threadedly engaged in screw holes 316 in the front ends 312.

Figure 5:
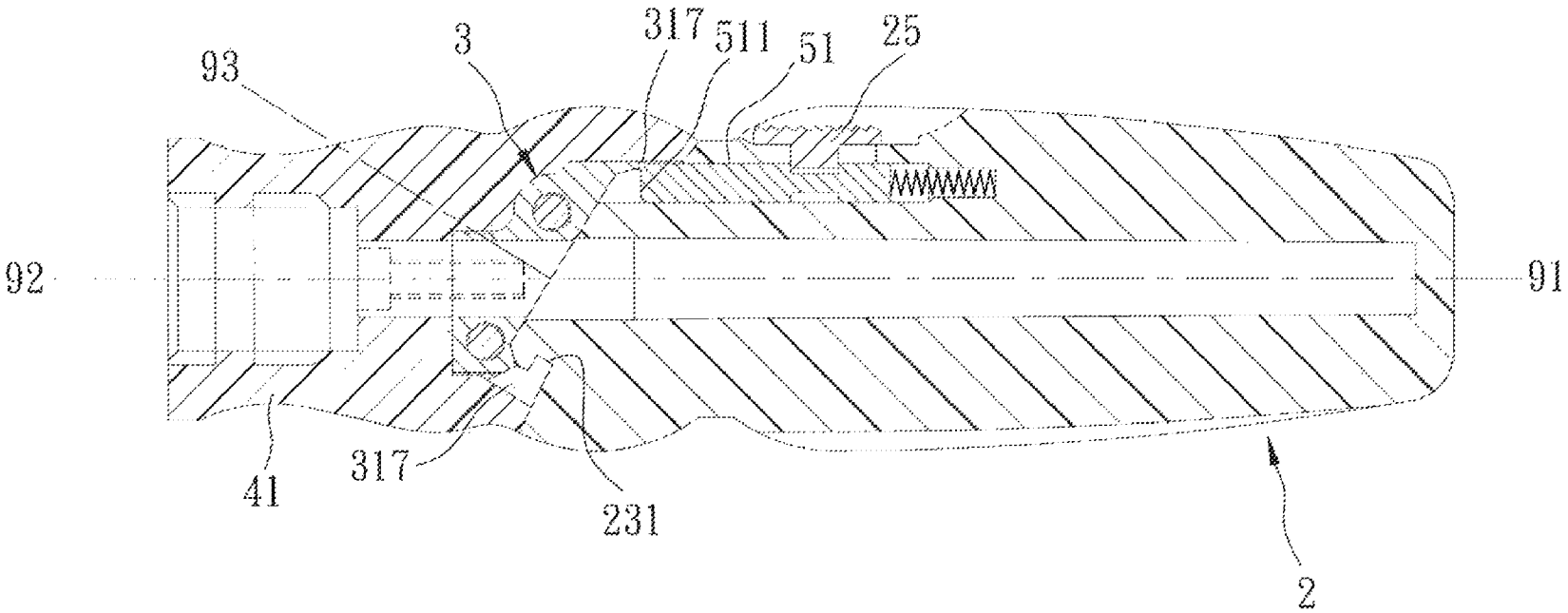
FIG. 5 is a sectional view of the first preferred embodiment in a normal position.
Figure 6:
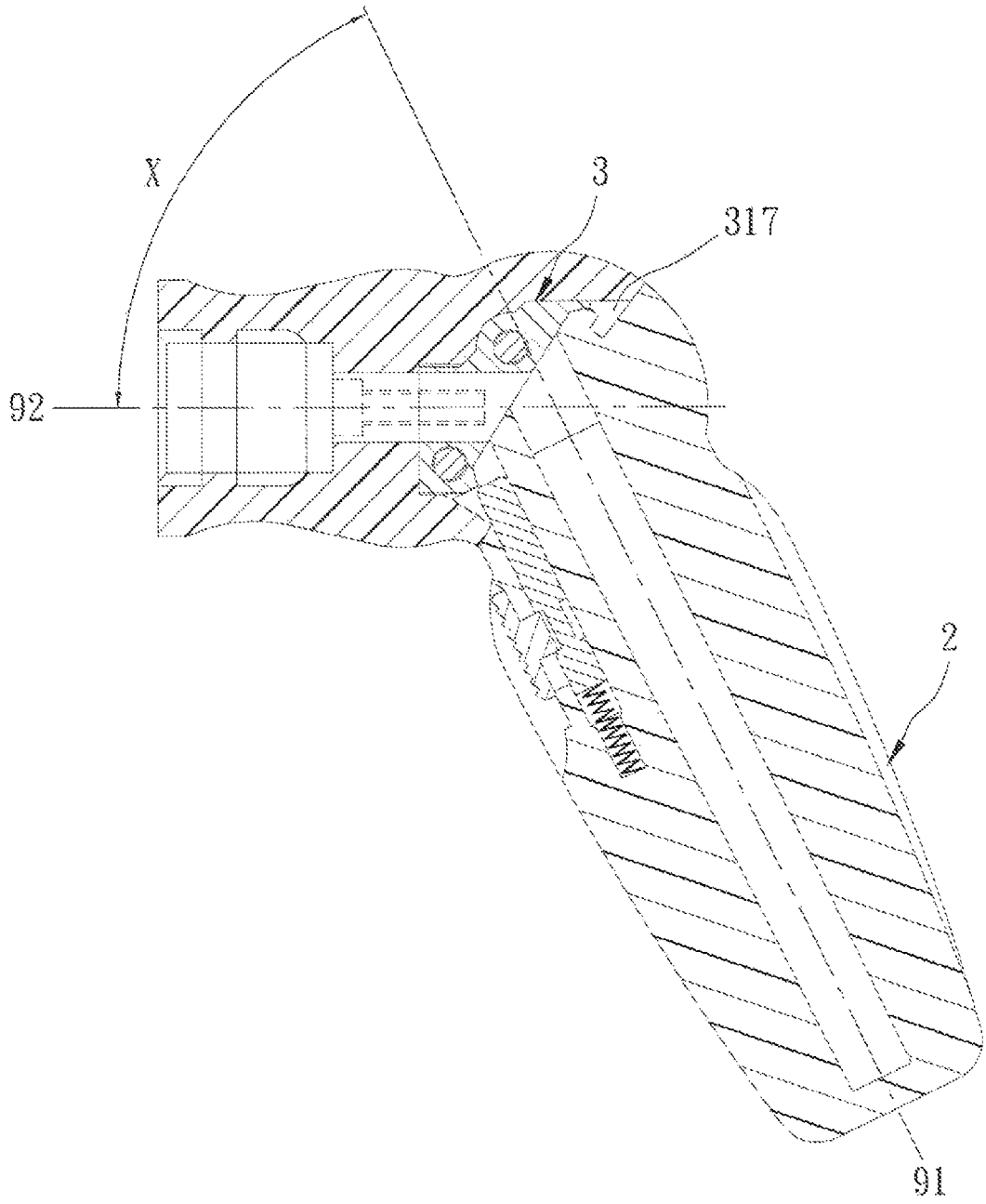
FIG. 6 is a sectional view of the first preferred embodiment in an angle-adjusted position.

Accordingly, the socket 3 is swivelable about the swivel axis 93 between a normal position, as shown in FIG. 5, where the first and second lengthwise axes 91, 92 are aligned with each other, and an angle-adjusted position, as shown in FIG. 6, where the first and second lengthwise axes 91, 92 are at an angle (X) with each other. Further, the tubular hole 24 is aligned and is communicated with one of the locking gaps 317 when the socket 3 is brought to one of the normal and angle-adjusted positions.

Figure 7:
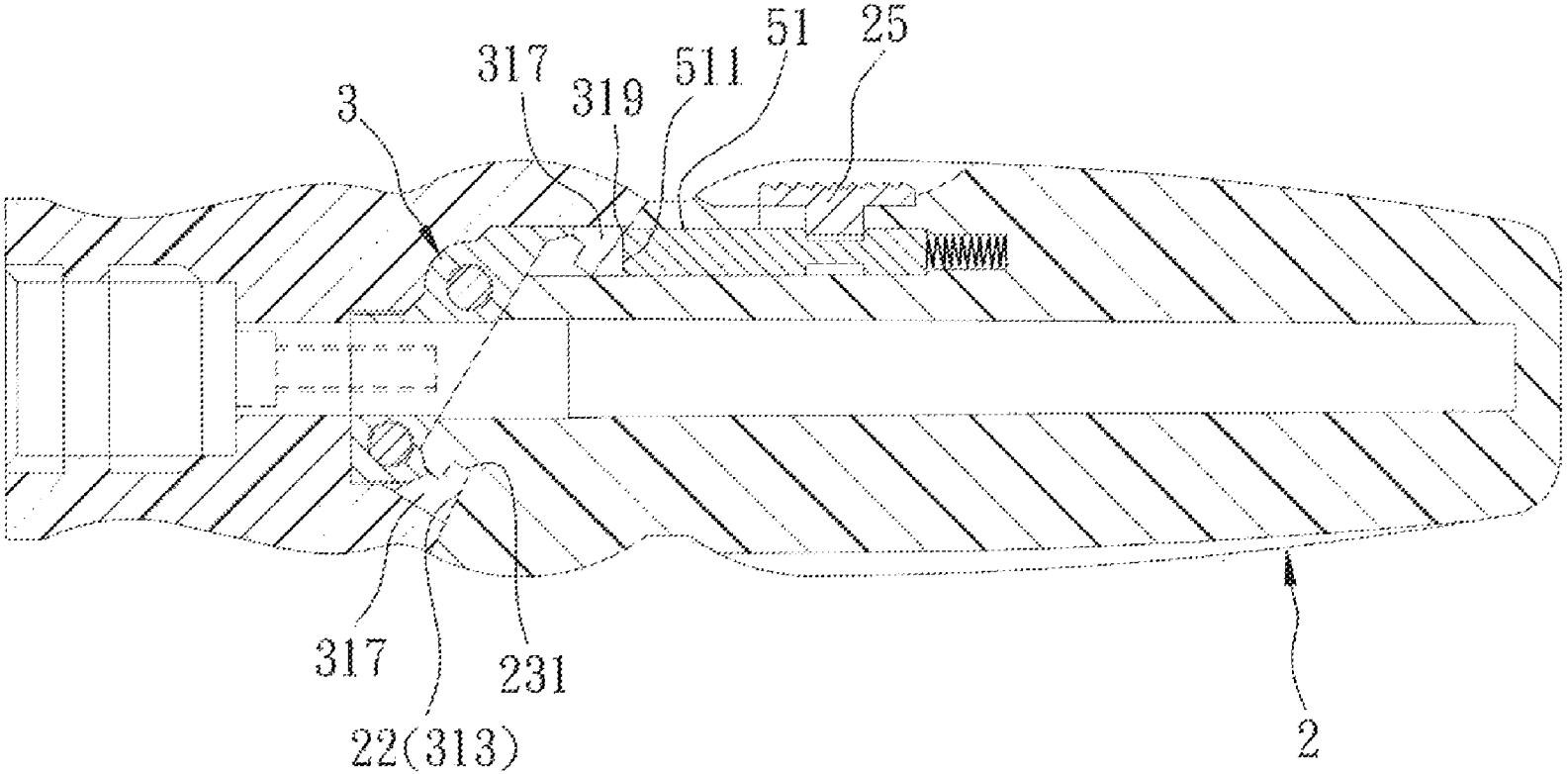
FIG. 7 is a sectional view of the first preferred embodiment when a latch in a retracted position.

The latch unit 5 includes a latch 51 and a spring 52. The spring-loaded latch 51 is disposed in the tubular hole 24 and is movable between a retracted position, where a latch end 511 of the latch 51 is disposed inwardly of the first tubular hole 24 while being urged to abut against the abutment surface 310, as shown in FIG. 7, and an extended position, as shown in FIGS. 5 and 6, where the latch end 511 extends into one of the locking gaps 317 to thereby retain the socket 3 to a selected one of the normal and angle-adjusted positions. The spring 52 is disposed to bias the latch 51 toward the extended position. The operating member 25 has a clamping portion 252 clamping a neck portion 514 of the latch 51 to move the latch 51 to the retracted position so as to permit the socket 3 and the second shank unit 4 to swivel relative to the first shank unit 2.

Since the left and right body halves 31 of the socket 3 are coupled with each other, and the second shank 91 by means of the screw fasteners 33, 49, and since the left and right inner flanges 315 are brought to be fitted in the guiding groove 231 to couple the socket 3 with the first shank unit 2, connection between the socket 3 and the first shank unit 2 is firm and steady. Even when the body halves 31 are worn out after a long-time use, replacement of the worn body halves 31 is easy and convenient to conduct. Moreover, the angle adjustable handle of this invention are constructed by component parts of relatively small and simple structures, which are easy to fabricate and assemble, thereby minimizing cost for manufacture thereof.

Figure 8:
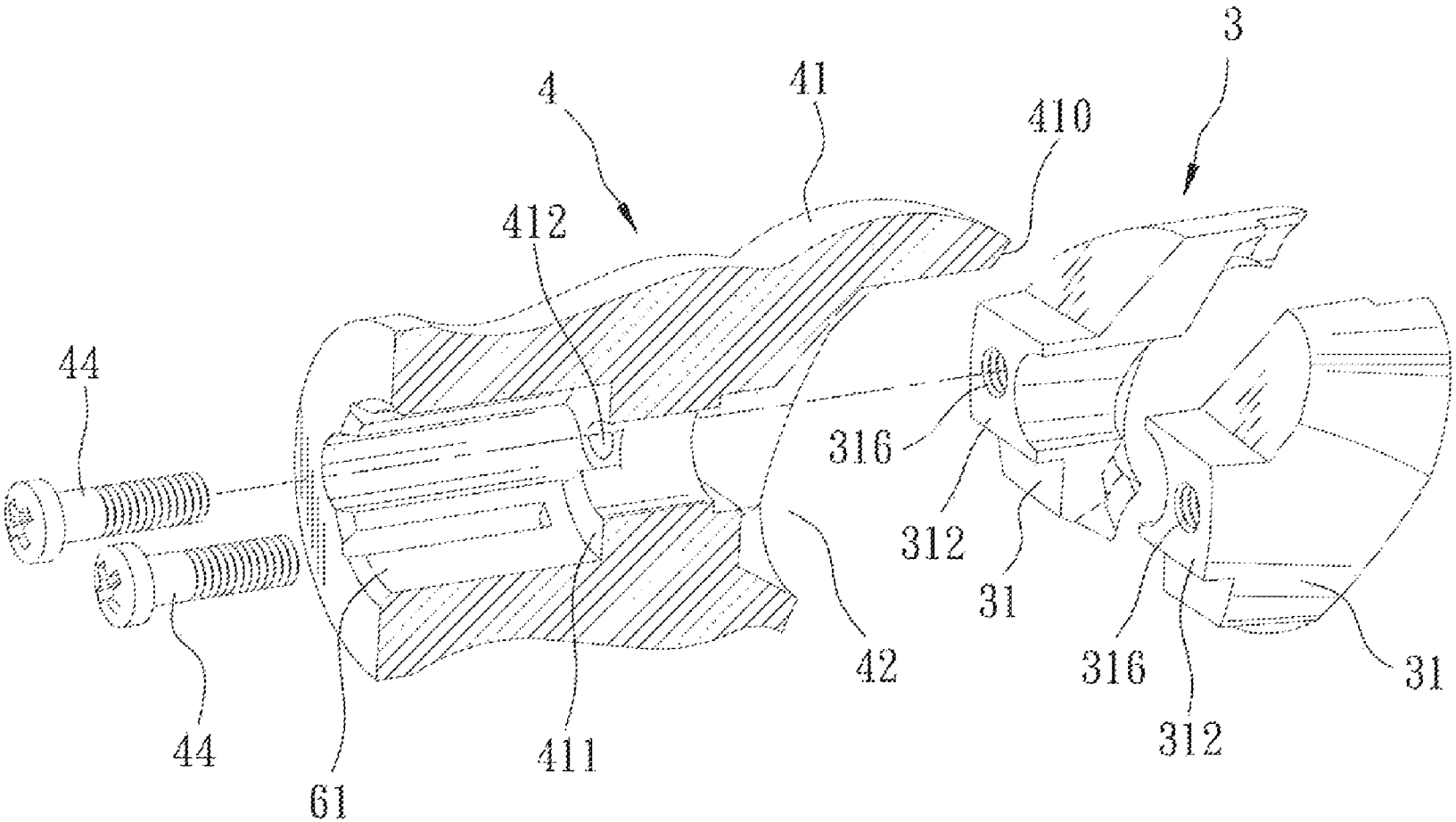
FIG. 8 is a partly fragmentary, exploded perspective view of a portion of the second preferred embodiment.

Referring to FIG. 8, the second preferred embodiment of the angle adjustable handle according to this invention is similar to the previous embodiment except that the screw fasteners 33 (see FIG. 3) are dispensed with. By means of the screw fasteners 44 extending through the through holes 412 and threadedly engaging in the screw holes 316, the left and right body halves 31 may be tightened together.

Figure 9:
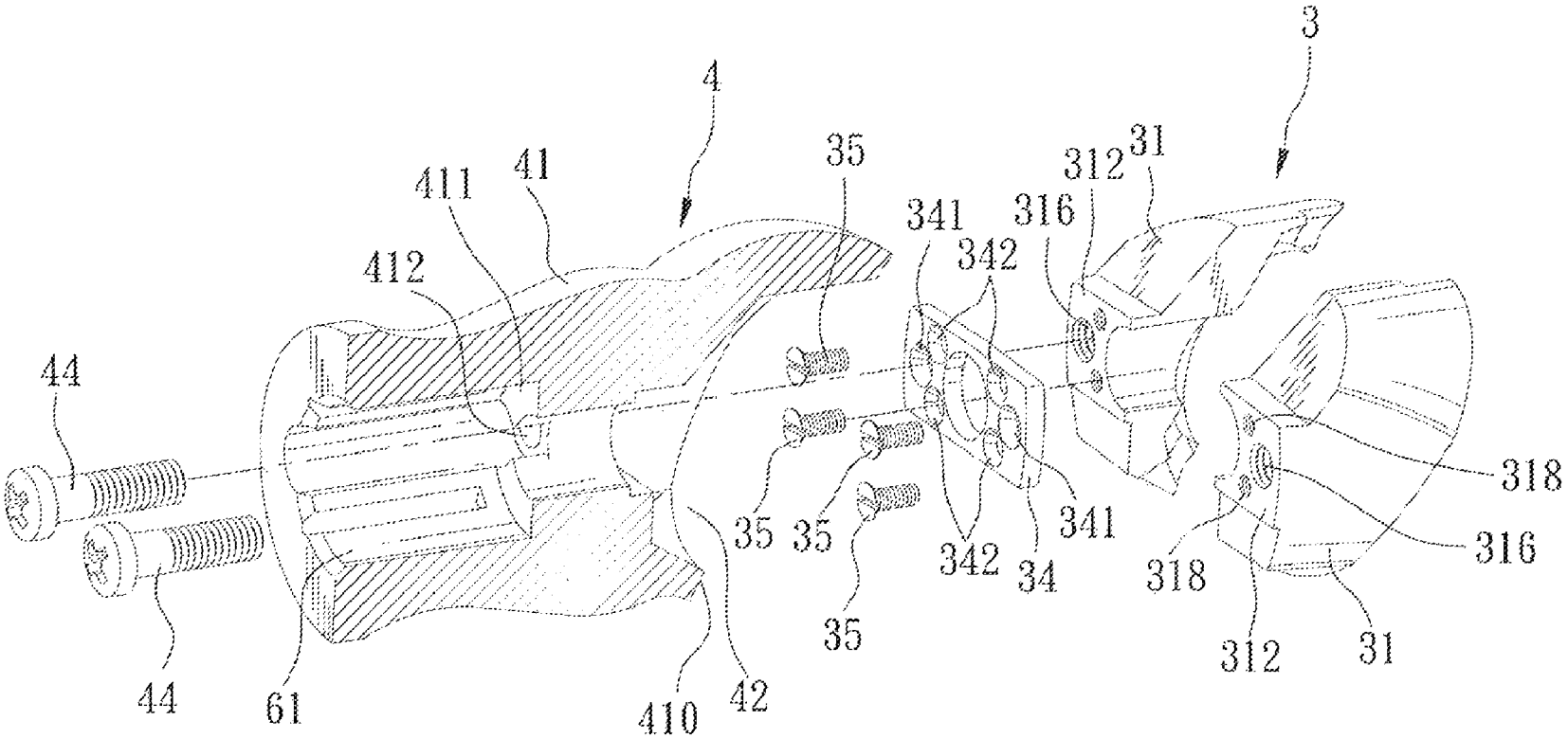
FIG. 9 is a partly fragmentary, exploded perspective view of the third preferred embodiment.

Referring to FIG. 9, the third preferred embodiment of the angle adjustable handle according to this invention is similar to the previous embodiments, except that the fastening unit includes a crosspiece 34 and four screw fasteners 35. The crosspiece 34 is sandwiched between the partition seat 411 and both of the left and right front ends 312 of the left and right body halves 31. The screw fasteners 35 are disposed to extend through four through holes 342 in the crosspiece 34 and threadedly engage in four screw holes 318 in the left and right front ends 312 so as to tighten the left and right body halves 31 to each other. Moreover, the screw fasteners 44 are disposed to extend through the through holes 412 and two through holes 341 in the crosspiece 34, and threadedly engage in the screw holes 316 so as to enhance the connection between the second shank 41 and the socket 3, as well as the connection between the socket 3 and the first shank unit 2.

Figure 10:
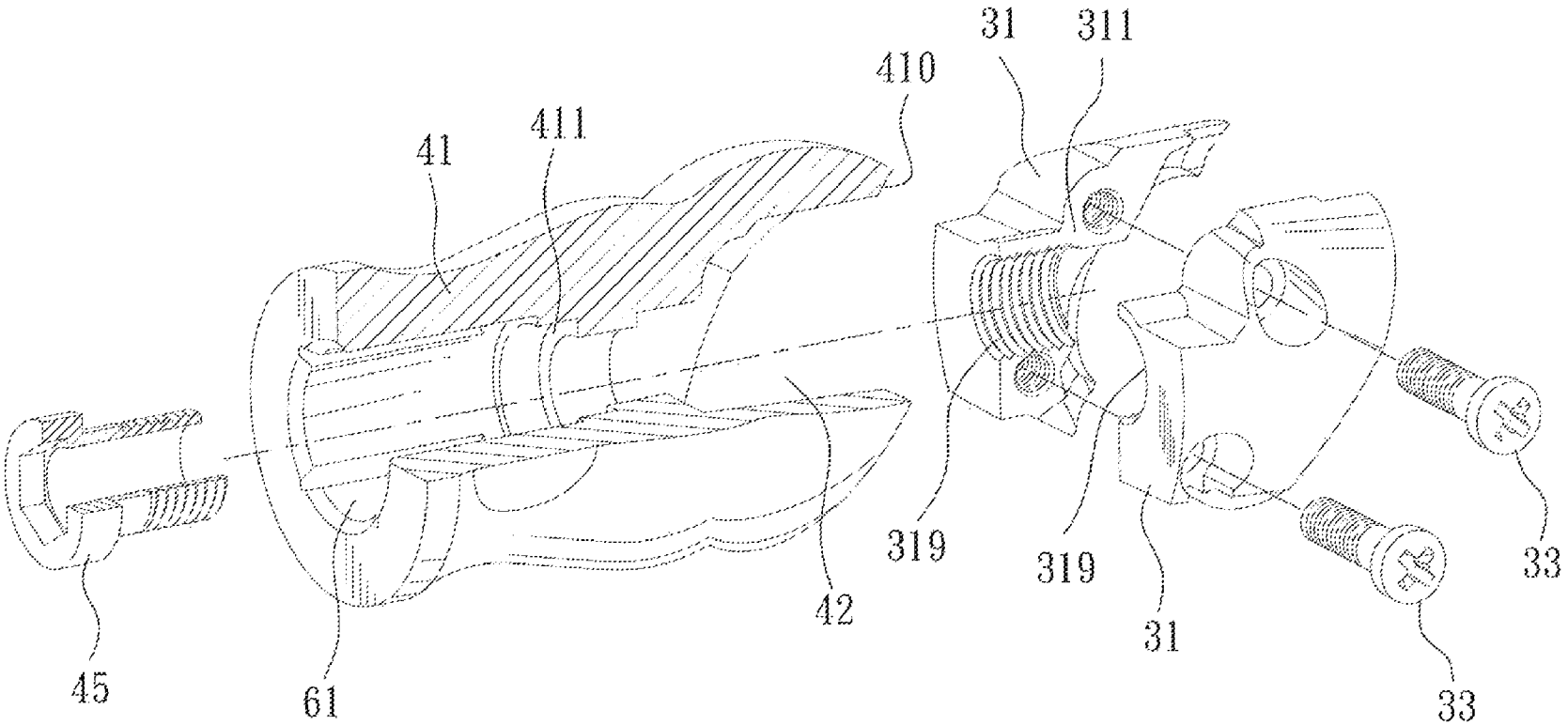
FIG. 10 is a partly fragmentary, exploded perspective view of a portion of the fourth preferred embodiment.

Referring to FIG. 10, the fourth preferred embodiment of the angle adjustable handle according to this invention is similar to the previous embodiments, except that the left and right body halves 31 respectively have left and right internally threaded halves 319 such that a screw bolt 45 is disposed to extend through the partition seat 411 and to be threadedly engaged with the left and right internally threaded halves 319.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. An angle adjustable handle for a hand tool, comprising:

a first shank extending along a first lengthwise axis to terminate at a first major surface;

a plug extending from said first major surface along a swivel axis that is normal to said first major surface, and that is at an angle with the first lengthwise axis;

a second shank extending along a second lengthwise axis to terminate at a second major surface that has an insertion opening extending along the second lengthwise axis;

a socket configured to be insertable into said insertion opening, and having left and right body halves which are opposite to each other radially to the second lengthwise axis and which are brought toward the second lengthwise axis to be tightened to each other, said left and right body halves respectively having left and right rear socket ends which extend in a circumferential direction about the swivel axis to define a socket cavity for accommodating said plug, and which cooperatively define an abutment surface configured to abut against said first major surface such that said socket is swivelable about the swivel axis between a normal position, where the first and second lengthwise axes are aligned with each other, and an angle-adjusted position, where the first and second lengthwise axes are at an angle with each other; and a spring-loaded latch disposed in said first shank and movable between a retracted position, where said latch is disposed inwardly of said first major surface, and an extended position, where said latch extends into said abutment surface to thereby prevent said socket from moving away from a selected one of the normal and angle-adjusted positions.

2. The angle adjustable handle according to claim 1, wherein said plug has a guiding groove extending in the circumferential direction, said left and right body halves respectively having left and right inner flanges which respectively extend from said left and right rear socket ends and towards the swivel axis, and which are brought to be fitted in and swivelable relative to said guiding groove about the swivel axis.

3. The angle adjustable handle according to claim 2, wherein said second major surface of said second shank is coplanar with said abutment surface and abuts against said first major surface.

4. The angle adjustable handle according to claim 1, wherein said left and right rear socket ends are spaced apart from each other in the circumferential direction by two locking gaps which are diametrically opposite to each other relative to the second lengthwise axis, and each of which is configured to permit said latch to be engaged therein when said latch extends into said abutment surface to thereby retain said socket in a selected one of the normal and angle-adjusted positions.

5. The angle adjustable handle according to claim 4, wherein said first shank has a tubular hole which extends along a direction of the first lengthwise axis through said first major surface and said plug to receive said latch therein, and which is aligned and communicated with one of said locking gaps when said socket is brought to the selected one of the normal and angle-adjusted positions.

6. The angle adjustable handle according to claim 5, wherein said first shank has a radial opening extending radially and communicated with said tubular hole, said handle further comprising an operating member which is disposed in said opening and which is manually operable to move said latch away from one of said locking gaps.

7. The angle adjustable handle according to claim 1, further comprising a bit mounting portion disposed in one of said first and second shanks and extending in a respective one of the first and second lengthwise axes for receiving and gripping a tool bit of the hand tool.

8. The angle adjustable handle according to claim 7, wherein said bit mounting portion is in form of a spline hole formed in said second shank, said second shank having a partition seat which is interposed between said spline hole and said insertion opening, said left and right body halves respectively having left and right front ends which abut against and are fastened to said partition seat.

9. The angle adjustable handle according to claim 8, further comprising a fastening unit which is disposed to tighten said left and right body halves to each other.

10. The angle adjustable handle according to claim 9, wherein said fastening unit includes a plurality of screw fasteners which extend in a radial direction relative to the second lengthwise axis.

11. The angle adjustable handle according to claim 9, wherein said fastening unit includes a crosspiece which is sandwiched between and fastened together with said partition seat and both of said left and right front ends when said left and right front ends are fastened to said partition seat, and which is configured such that, when said crosspiece is fastened to said left and right front ends, said left and right body halves are tightened to each other.

12. The angle adjustable handle according to claim 8, wherein said left and right body halves respective have left and right internally threaded halves such that a screw bolt is disposed to extend through said partition seat and to be threadedly engaged with said left and right internally threaded halves.

* * * * *